United States Patent [19]

Hall et al.

[11] Patent Number: 5,030,162

[45] Date of Patent: Jul. 9, 1991

[54] PHANTOM MARIONETTE

[76] Inventors: Robert M. Hall, Blaauwklip Rd., P.O. Box 7077, Stellenbosch 7610, South Africa; Bernie Miller, 6401-1 Platt Ave., West Hills, Calif. 91307

[21] Appl. No.: 616,231

[22] Filed: Nov. 19, 1990

[51] Int. Cl.[5] ..... A63J 19/00

[52] U.S. Cl. ..... 446/363; 446/361

[58] Field of Search ..... 446/82, 83, 84, 227, 446/361, 362, 363, 364, 365; 40/411

[56] References Cited

U.S. PATENT DOCUMENTS

| | | | |
|---|---|---|---|
| 1,505,942 | 8/1924 | Blanton | 446/363 X |
| 1,902,983 | 3/1933 | Adler et al. | 446/363 |
| 1,987,528 | 1/1935 | Fukumoto | 446/363 |
| 2,113,839 | 4/1938 | Hedges | 446/363 |
| 2,760,305 | 8/1956 | Hetrick | 446/363 |

FOREIGN PATENT DOCUMENTS

| | | | |
|---|---|---|---|
| 2495486 | 6/1982 | France | 446/363 |

*Primary Examiner*—Mickey Yu
*Assistant Examiner*—Sam Rimell
*Attorney, Agent, or Firm*—Beehler & Pavitt

[57] ABSTRACT

A marionette comprised of a single three dimensional object covered by a thin flexible silk-like sheet, preferably square, and connected by a filament to the center of an H-shaped handle member, with each corner of the fabric being attached to a small weight which itself is also connected by a filament to an extremity of the handle member. When the handle member is held above, parallel to, and spaced from the sheet to where the sheet is disposed close to a floor or the ground and all filaments are taut, manipulating the handle as it is moved in any direction parallel to the floor or ground produces an unusual undulating movement. Means are provided on the handle member to wind the filaments to positions where they will not become entangled when the marionette is put away, packaged and/or transported.

11 Claims, 2 Drawing Sheets

14b
10
48
14a
12
42
16b
46
16b
32
32
28
40
20
38
36
18
22
30
30
26
24
30

PHANTOM MARIONETTE

FIELD OF THE INVENTION

This invention relates generally to the toy field and particularly to toys in the form of marionettes.

BACKGROUND OF THE INVENTION

A. Description of the Prior Art

Marionettes have been known and used in a number of countries for more than a century. They have served not only as entertainment devices, such as puppets in puppet shows, but also as toys to be manipulated by children and adults to amuse themselves and others.

Heretofore, to the knowledge of the present inventor, marionettes have been formed as bodies with articulatable members such as arms, legs, torsos and heads in the form of some type of human being or caricature of a human being or an animal. Strings or filaments are attached to the articulated members and brought up above the object being manipulated to some type of control element by means of which the connected member may be moved upwardly or downwardly. When a plurality of the strings or filaments connected to the articulated members are brought together on or about the element, either manipulation of the element or one or more filaments by a person holding the element, enables the person to make the object imitate or engage in movements similar to those of a human being or animal which the object may appear to be, generally in minature.

SUMMARY OF THE INVENTION

The present invention utilizes some aspects of standard marionette or puppet technology, but differs in that, instead of providing a body having articulated members, the body may be simply a self-contained three dimensional object, such as a sphere or polyhedron, either covered with or attached to a thin flexible sheet of fabric, such as silk, rayon or nylon, extending laterally from the object and preferably in the form of a square. Attached to each of the corners of the square, preferably below the fabric, is a small element of a weight just sufficient to cause the fabric corner to drop vertically until it rests upon a horizontal surface, such as a floor or table.

A handle element is provided which may be in the form of a cylindrical central member from each end of which projects a pair of oppositely extending rigid arms. Each of the weighted elements covered by or attached to a corner of the sheet is then connected by a thread or filament to the end of one of the projecting arms of the handle. Also, another thread or filament is connected between the cylindrical central member to the three dimensional object through the fabric covering the latter. Desirably, the lengths of the filaments connecting the weighted elements to the extremities of the arms extending from the handle member are equal and the length of the filament connecting the object to the handle member may be slightly shorter than the length of the other filaments, with the result that when the handle is held in a horizontal plane sufficiently above the fabric sheet to where all of the filaments are taut and the sheet is disposed on a floor or other horizontal surface, the object preferably covered by the sheet, will be elevated somewhat above the corners of the fabric. Desirably, also that portion of the fabric which covers the object may be painted or otherwise marked with eyes and a mouth, or otherwise configured.

So constructed and with the handle held in a horizontal plane at an elevation where the filaments are taut, but the fabric still rests upon or is disposed just slightly above the horizontal surface, manipulation of the handle will produce an interesting undulating movement of the fabric about the covered object, and, if the handle is then moved in a horizontal plane during such manipulation, the fabric with its marked cover over the object, may produce the appearance of a phantom or "spook" flowing across the horizontal surface as though by some articulated elements below the fabric. Such movement of the phantom or spook will be found to be most entertaining.

While marionettes constructed in accordance with the present invention, are unique and, when operated, display a most unusual movement of the object and its covering fabric, they may be found to be somewhat difficult to package, transport and set up as the filaments may easily become entangled. It is thus also a feature of the invention to provide means to minimize the likelihood of filament entanglement. This may be accomplished by providing at least one, and preferably more upwardly projecting posts on the pairs of arms laterally extending from the cylindrical member of the handle. In addition, each of the object and weighted elements is adhered or otherwise secured to the fabric, so that it cannot move downwardly relative fabric and draw with it a part of the filament to which it is connected to increase the likelihood of entanglement with other filaments or the fabric itself.

By providing the posts on the pairs of laterally extending arms, when it is desired either to package the marionette, or to put it away after use, each of the filaments extending to a weighted element at a corner of the fabric may be looped back and forth over one or more posts on one arm and one or more posts on the other parallel arm extending from the opposite end of the cylindrical handle member. Thereby, the filaments may be retained tautly between such parallel arms when the marionette is not being manipulated or readied for manipulation, to avoid undesired entanglement of the filaments.

DESCRIPTION OF THE PREFERRED EMBODIMENT

Figure 1:
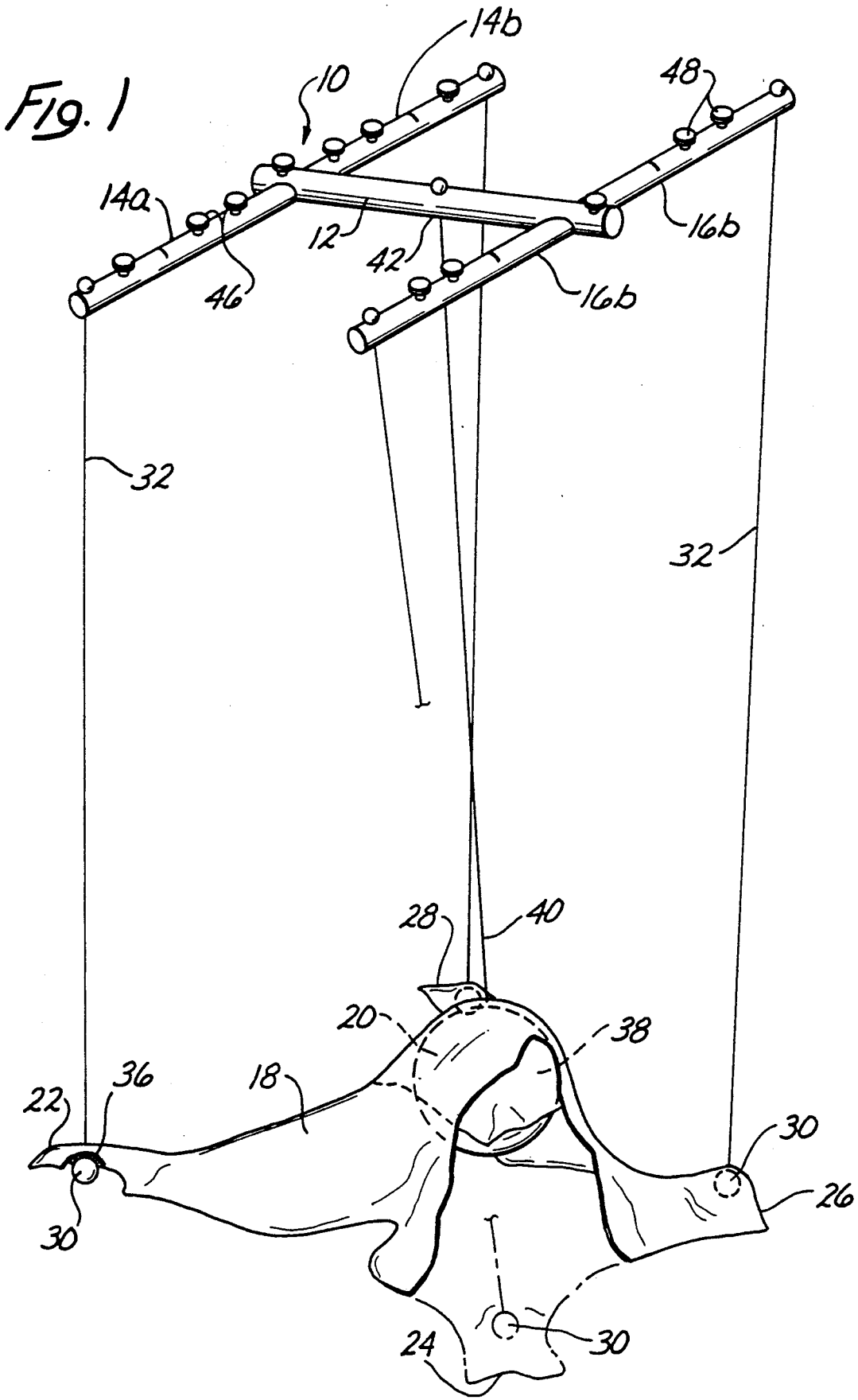
FIG. 1 is a perspective view, partially broken away showing the arrangement of the several elements of the invention in open manipulatable position.

Referring to FIG. 1 of the drawings, a marionette may be constructed of an H- shaped handle member 10 comprised of a central handle piece 12 from each end of which extends laterally a pair of oppositely projecting arms 14*a*, 14*b*, and 16*a*, 16*b*, to form an H-shaped pattern. Below the member 10 there is provided a thin flexible square sheet 18 of a material such as silk, rayon or nylon underneath the center of which, and preferably secured to the underside of the fabric 18, is a sphere 20 or some other three-dimensional object, such as a polyhedron. Below each corner 22, 24, 26 and 28 of the fabric is a small weighted element 30 such as a shot or fishing weight, which is connected by a filament 32 passed through the fabric 18 and extending up to an end 32 of one of the arms 14*a*, 14*b*, 16*a*, 16*b*, of the member 10 Desirably, each of the weighted elements 30 is permanently secured by an adhesive 36 to the underside of the fabric at the point where the filament 32 passes through it. Desirably also, a reinforcing sheet of material 38 is interposed between the sphere or polyhedron 20 and the underside of the sheet 18 and a further filament 40 is connected between the sphere 20 and the central member 12 at a point 42 with this filament 40 being passed through the reinforcing sheet 38 and the covering sheet of fabric 18. In addition, desirably, at least a portion of the sphere 20 is adhered to the reinforcing sheet 38 and the latter, in turn, is adhered to the underside of the sheet 18. The upperside of the sheet 18 which actually covers the sphere 20 may be decorated with a pair of eyes 44 or other markings as shown in FIG. 3.

Lastly, the upper edges of the projecting arms 14*a*, 14*b*, 16*a*, 16*b*, may be provided with a series of small upperwardly extending posts or projections 46, each of which may be capped with a small head 48.

In use, the H-shaped control member may be held at a level at which each of the filaments 32 and the central filament 40 is taut while the fabric 18 covering the sphere 20 and the weighted elements 30 rest on a floor, ground or other horizontal surface. In this disposition, it will be found that if the member 10 is even slightly manipulated in a rocking manner and moved parallel to the floor or other horizontal surface, the Figure 50 will appear to undulate across the floor in the manner of some type of small mammal or member of the fish species in a ghost or spook-like manner, thereby providing an unusual entertainment to the operator or observer.

Figure 2:
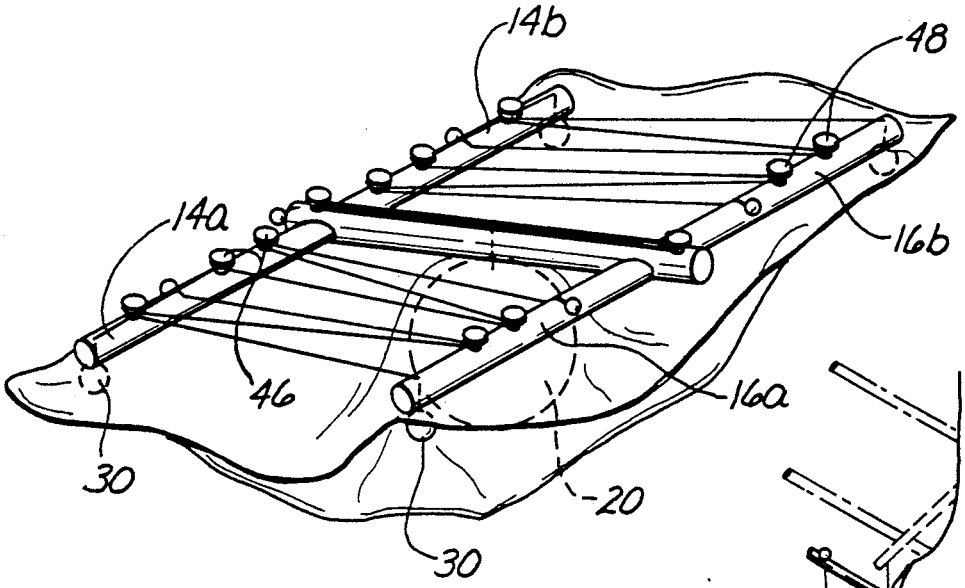
FIG. 2 is a perspective view of the invention compacted for transporting or storing.
Figure 3:
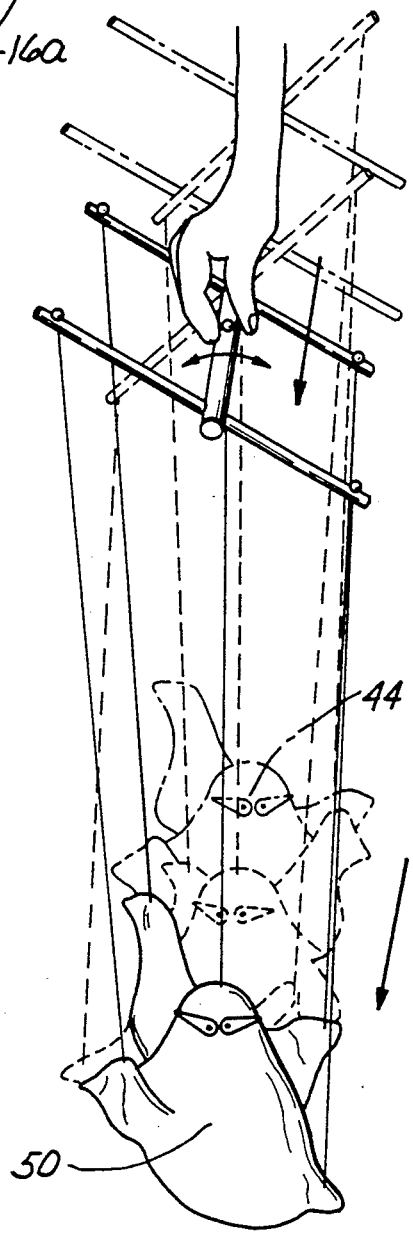
FIG. 3 is a perspective view showing the effect of manipulating the marionette.

While the marionette is simple to operate in the manner shown in FIG. 3, it will be found that unless special provision is made to reel up the filaments 32 and 40, they may easily become entangled when the marionette is put away after usage or packed for transportating. Such reeling up of the filaments 32 and 40 may be accomplished by winding them back and forth across the projecting arms 14*a*, 14*b*, 16*a*, and 16*b*, around the upwardly extending projections 46 and under the heads 48 of the latter in the manner shown in FIG. 2. When this is done carefully, one filament at a time, it will be found that the fabric 18 and the sphere 20 and weighted elements 30 will all be drawn up against the underside of the handle member 10, as thus shown in FIG. 2. In this condition, the marionette may be conveniently put away after use or may be packaged for marketing.

It will be appreciated that the marionette of the present invention may be made in other configurations with respect to both the handle and the fabric which it carries. Thus, the fabric could be triangular in shape and the handle T-shaped instead of H-shaped with the object preferably centered below the sheet and only three corner filaments and the object filament being employed.

The marionette will also be found to be inexpensive to fabricate and to package, and is so simple to operate that it may be manipulated by a child of as young as four or five years of age. Because of the unusual movement of the fabric when the handle member is manipulated, the marionette will provide wide widespread entertainment among those who not only engage in the actual mainpulation, but also for those who observe the spooky movement which such manipulation produces.

We claim:

1. A marionette comprising:

a thin flexible sheet of fabric, said sheet having at least three corners, a three dimensional object, said object being disposed inwardly of at least some of the corners of said sheet and secured to said sheet;

a handle, said handle comprising a central member having a plurality of lateral extensions, the number of said extensions equaling the number of corners of said sheet, the extremity of each extension being disposed in general vertical alignment with a corner of the sheet when the sheet is spread out on a horizontal surface and the handle is disposed above, parallel to, and spaced from said sheet;

a weighted element attached to each corner of said sheet;

a flexible filament extending between each of the last said elements, and the aligned extremity of the handle extension; and a further flexible filament connected between the handle and the object;

the lengths of the filaments being such that when, the handle is disposed above, parallel to, and in vertical alignment with, and spaced from, the sheet of fabric, the sheet of fabric may lie in a horizontal plane on said surface with the three-dimensional object projecting above the fabric by at least a substantial part of its height, whereby when the fabric sheet is so disposed on the horizontal surface and the handle is so held above and spaced from the fabric sheet with the filaments taut, manipulation of the handle as the latter is moved in a direction parallel to the horizontal surface, produces an apparent undulation and flowing of the fabric sheet in the direction of the horizontal movement of the handle.

2. The marionette as described in claim 1 wherein the three dimensional object is a sphere, said sphere is disposed below the fabric, and the filament connecting the object to the handle extends through the fabric.

3. The marionette as disclosed in claim 2 wherein the upper surface of the sheet is marked around the area covering the sphere to produce a facial appearance.

4. The marionette as described in claim 1 wherein each of the weighted elements attached to a corner of the fabric is disposed below the fabric and the filament connecting each element with an extremity of the handle extends through the corner of the sheet.

5. A marionette as described in claim 1 wherein the sheet is a rectangle and the central member has a pair of oppositely extending lateral extensions adjacent each of the extremities to result in an H-shape.

6. A marionette as described in claim 1 wherein the flexible sheet is of a light silken material.

7. A marionette as described in claim 2 wherein the sphere is hollow and of plastic.

8. The marionette as described in claim 1 wherein the weighted elements are adhered to the underside of the fabric.

9. The marionette as described in claim 5 wherein short upwardly extending posts are provided on the top sides of lateral extensions of the handle, over which posts the filaments may be looped when it is desired to put away or transport the marionette, and to minimize entanglement of the filaments.

10. The marionette as described in claim 1 wherein the three dimensional object is adhered to the underside of the fabric.

11. The marionette as described in claim 1 wherein a reinforcing sheet is interposed between the object and the covering sheet of fabric.

* * * * *